US005255894A

United States Patent [19]

Guarneri

[11] Patent Number: 5,255,894

[45] Date of Patent: Oct. 26, 1993

[54] ELECTROMAGNETIC CARPET STRETCHER DEVICE

[76] Inventor: Richard Guarneri, 12 W. Lincoln Ave., Valley Stream, N.Y. 11580

[21] Appl. No.: 784,385

[22] Filed: Oct. 29, 1991

[51] Int. Cl.[5] ..... A47G 27/04

[52] U.S. Cl. ..... 254/200; 227/131; 173/117; 294/8.6

[58] Field of Search ..... 254/199, 200; 227/131; 173/117; 294/8.6

[56] References Cited

U.S. PATENT DOCUMENTS 2,967,302 1/1961 Loveless ..... 173/117

4,361,311 11/1982 Koroyasu et al. ..... 254/200

*Primary Examiner*—Andrew M. Falik

*Attorney, Agent, or Firm*—Ilya Zborovsky

[57] ABSTRACT

A carpet stretcher device has an engaging head adapted to engage carpet and having a rear end, a housing connected with the rear end of the engaging head, an electromagnetic coil arranged in the housing and adapted to generate an electromagnetic field, a plunger movable in the housing in a longitudinal direction under the action of the electromagnetic field of the electromagnetic coil and adapted to strike the housing so as to transmit its strike to the rear end of the engaging head. The electromagnetic coil has a throughgoing passage extending in the longitudinal direction. The plunger has a central portion extending through and guided in the passage of the electromagnetic coil and two end portions connected with two opposite ends of the central portion and located outwardly beyond two opposite ends of the coil.

11 Claims, 2 Drawing Sheets

ELECTROMAGNETIC CARPET STRETCHER DEVICE

BACKGROUND OF THE INVENTION

The present invention relates to a carpet stretcher device.

Carpet stretcher devices are disclosed for example in U.S. Pat. Nos. 2,882,642; 3,374,203; 4,361,311. A carpet stretcher device disclosed in the latter mentioned patent includes a housing with a handle, an electromagnetic coil accommodated in the housing, a plunger axially slidable inside the coil, and a spindle fixed to the rear end of an engaging head for engagement with carpets. Upon energization of the electromagnetic coil the plunger is advanced to strike the rear end of the engaging head with its front end. This existing carpet stretcher device can be further improved to provide a better guidance of the plunger and make the device more efficient.

SUMMARY OF THE INVENTION

Accordingly, it is an object of the present invention to provide a carpet stretcher device which has increased stretching force, improved guidance and high efficiency.

In keeping with these objects and with others which will become apparent hereinafter, one feature of the present invention resides, briefly stated, in a carpet stretcher device which has a housing, an electromagnetic coil accommodated in the housing, an engaging head for engaging the carpet, and a plunger advanced by the electromagnetic coil to strike a read end of the engaging head, wherein the plunger has a central narrow part extending through the interior of the electromagnetic coil and to end parts located outside of axial ends of the coil and connected with the central part so that during the movement of the plunger the central part of the plunger is guided in the electromagnetic coil while the wider end parts move outside of the electromagnetic coil.

When the carpet stretcher device is designed in accordance with the present invention, it provides a high stretching force, an improved guidance and high efficiency.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
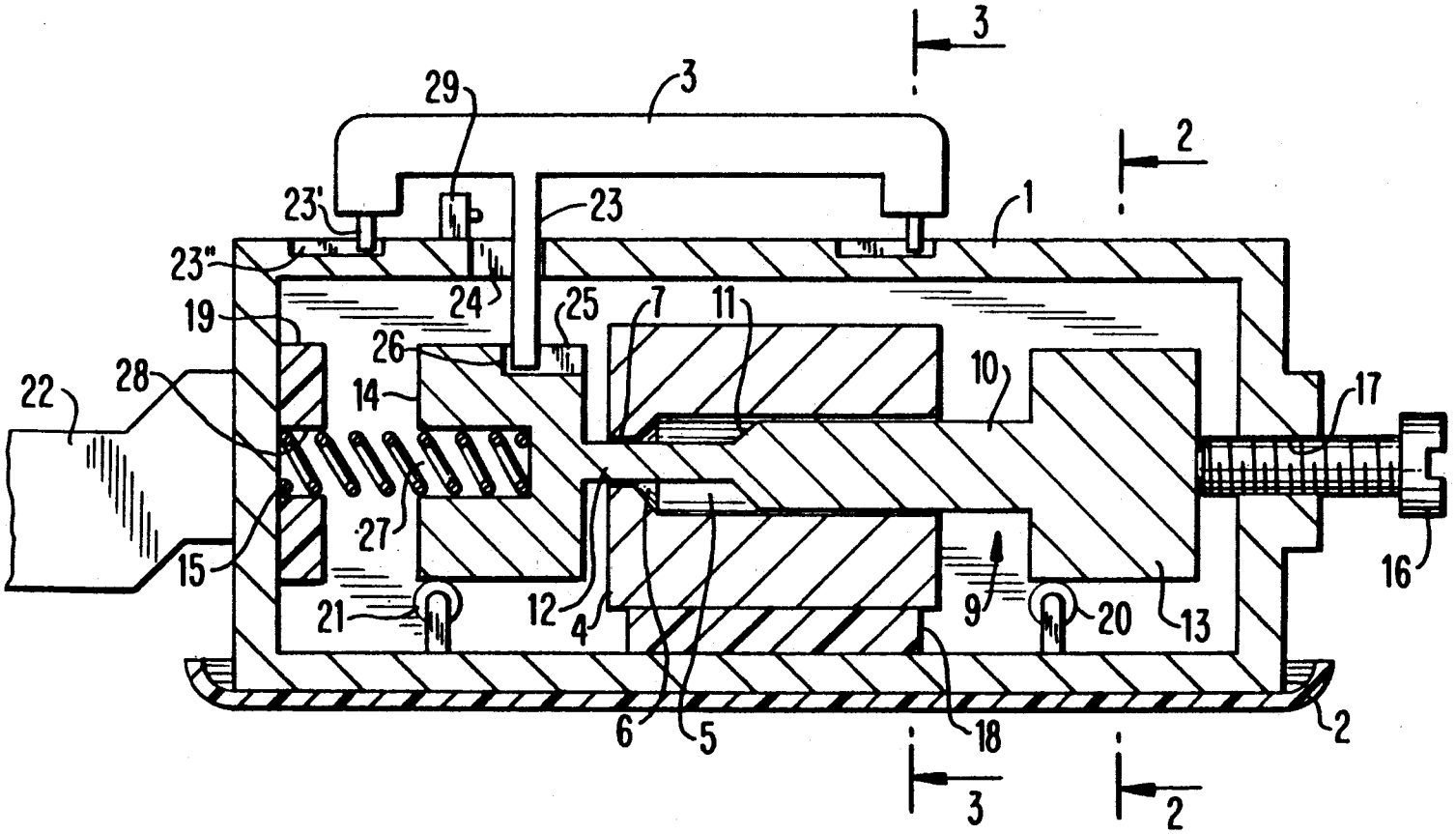
FIG. 1 is a view schematically showing a carpet stretcher device in accordance with the present invention.
Figure 2:
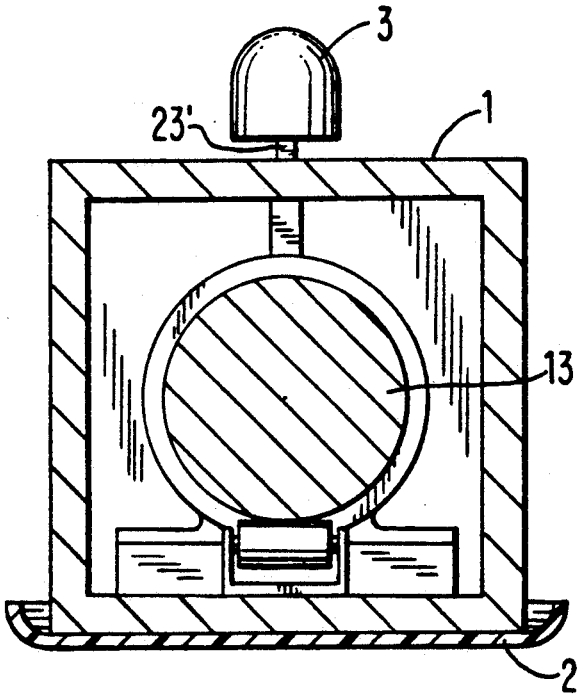
FIG. 2 is a view showing a section of the carpet stretcher device taken along the line 2—2 in FIG. 1.
Figure 3:
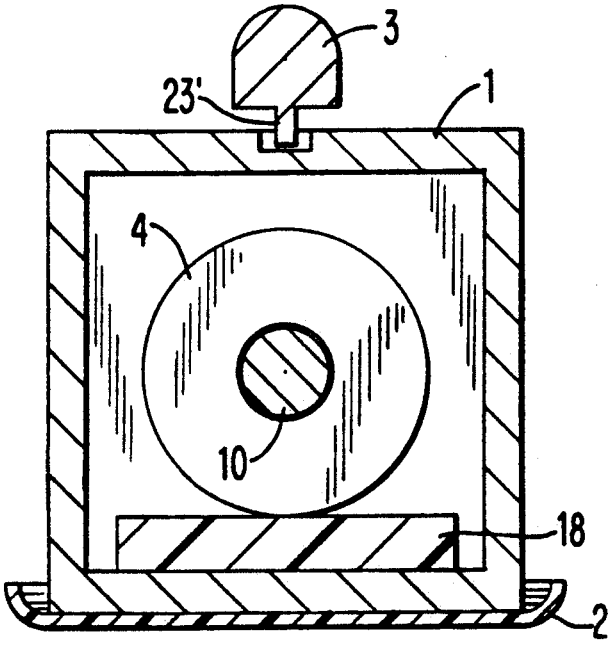
FIG. 3 is a view showing a section taken along the line 3—3 in FIG. 1.

A carpet stretcher device in accordance with the present invention has a housing which is identified as a whole with reference numeral 1. The housing is supported on a low friction base composed for example of tetrafluorethylene and provided with a handle 3. An electromagnetic coil 4 is accommodated in the interior of the housing 1 and has a central passage 5, an intermediate passage 6, and an end passage 7. The electromagnetic coil 4 is a part of a solenoid connected with a power source and adapted to be energized by a switch. The central passage 5 and the end passage 7 can be cylindrical while the intermediate passage 6 can be conical so as to form a conical wall inside the electromagnetic coil 4. The plunger which is identified as a whole with reference numeral 9 is longitudinally movable in the housing. The plunger has a central portion which includes three sections 10, 11, and 12. The sections 10 and 12 can be cylindrical with a cross-section substantially corresponding to the cross-section of the passages 5 and 7 in the electromagnetic coil while the section 11 can be conical with a shape substantially corresponding to the shape of the wall formed by the passage 6 of the electromagnetic coil. The plunger further has two end portions 13 and 14 connected with the opposite ends of the central portion. While the central portion of the plunger is adapted to move inside the electromagnetic coil 4, the end portions 13 and 14 of the plunger move outside of the electromagnetic coil. The central portion 10, 11, 12 of the plunger is substantially narrow. The end portions 13 and 14 of the plunger are substantially wide and have a weight which substantially exceeds the weight of the central portion of the plunger. The end portions of the plunger can have substantially identical weights.

A return spring 15 normally urges the plunger 9 to the right in FIG. 1 of the drawings. An adjusting screw 16 is screwed in a threaded opening 17 in the end wall of the housing 1 and can be axially displaced in a longitudinal direction so as to increase or reduce the stroke of the plunger and therefore adjust a striking force of the plunger. A shock absorbing element 18 is arranged between the lower surface of the electromagnetic coil 4 and the bottom of the housing 1 and composed of an elastic material. A hard plastic pad 19 is located on the inner surface of the front wall of the housing 1. A roller 21 rotatably mounted on the bottom of the housing supports the end part 14 of the plunger to reduce the friction, while a roller 20 rotatably mounted on the bottom of the housing supports the end portion 13 of the plunger also to reduce the friction.

The device is further provided with an engaging head 22 which is shown only partially and used to engage a carpet and to stretch it in a known manner. The rear end of the engaging head 22 is connected with the front wall of the housing 1. The handle 3 has a projection 23 which extends through a slot 24 in the upper wall of the housing 1 and engages in a groove 25 provided in the end portion 14 of the plunger 9. The groove 25 has a front wall 26. The handle 3 has projections 23' which engage in grooves 23'' of the upper wall of the housing so that the handle 3 can be longitudinally displaced relative to the housing by the user with the projections 23' sliding in the grooves 23''. The end portion 14 of the plunger also has a passage 27 in which a portion of the return spring 15 is received. The front end of the spring 15 is received in a passage 28 formed in the pad 19. Finally, a switch 29 is arranged on the upper wall of the housing 1.

The carpet stretcher device in accordance with the present invention operates in the following manner.

The device is installed on a carpet and its engaging head 22 engages the desired portion of the carpet. Then the switch 29 is turned on by a user holding the handle 3 and the electromagnetic coil 4 is energized. Under the action of the electromagnetic field generated in the coil the central portion of the plunger is pulled forwardly or to the left in FIG. 1 and is guided over its substantial length inside the coil. The front face of the end portion 14 of the plunger 9 strikes against the pad 19 and the energy of the strike is transmitted to the end portion of the engaging head 22. During the strike the substantial weight of both portions 13 and 14 applies the striking force. The forward displacement of the plunger is stopped when the conical portion 11 stops a short distance behind the wall formed by the conical passage 6 of the electromagnetic coil. During displacement of the plunger the friction between the plunger and the housing is reduced to a minimum due to the rollers 20 and 21. The length of the stroke of the plunger can be adjusted by the adjusting screw 16.

In accordance with another advantageous feature of the present invention, the user turns on the switch 29 and at the same time moves the handle forwardly or to the left in FIG. 1. The projection 23 of the handle pushes the spindle forwardly so as to overcome the stationary friction of the spindle and then the electromagnetic field of the electromagnetic coil 4 moves the plunger further. In other words the movement of the plunger by electromagnetic coil starts not from the stationary condition of the plunger, but instead from the dynamic condition, or in other words in the process of movement of the plunger imparted by the user. Also during movement of the plunger under the action of the electromagnetic coil it can be accelerated by hand in the same manner.

It will be understood that each of the elements 25 described above, or two or more together, may also find a useful application in other types of constructions differing from the types described above.

What is claimed as new and desired to be protected by Letters Patent is set forth in the appended claims:

1. A carpet stretcher device comprising an engaging head adapted to engage carpet and having a rear end; a housing connected with said rear end of said engaging head; an electromagnetic coil arranged in said housing and adapted to generate an electromagnetic field; a plunger movable in said housing in a longitudinal direction under the action of the electromagnetic field of said electromagnetic coil and adapted to strike said housing so as to transmit its strike to said rear end of said engaging head, the electromagnetic coil having a throughgoing passage extending in the longitudinal direction, said plunger having a central portion extending through and guided in said passage of said electromagnetic coil and two end portions connected with two opposite ends of said central portion and located outwardly beyond two opposite ends of said coil.

2. A carpet stretcher device as defined in claim 1, wherein said central portion of said plunger is substantially narrow, said end portions of said plunger are substantially wide and having a weight substantially exceeding a weight of said end portion.

3. A carpet stretcher device as defined in claim 1, wherein said end portions of said plunger have substantially identical weight.

4. A carpet stretcher device as defined in claim 1; and further comprising means for guiding said end portions of said plunger in said housing and including roller means.

5. A carpet stretcher device as defined in claim 4, wherein said roller means including a first roller rollingly supporting one of said end portions of said plunger and a second roller rollingly supporting the other of said end portions of said plunger.

6. A carpet stretcher device as defined in claim 1; and further comprising a shock absorbing element located between said electromagnetic coil and said housing.

7. A carpet stretcher device as defined in claim 1; and further comprising a pad arranged on an inner surface of said housing so that said plunger first strikes against said pad.

8. A carpet stretcher device as defined in claim 1; and further comprising an adjusting member arranged to adjust a stroke of said plunger.

9. A carpet stretcher device as defined in claim 8, wherein said adjusting member is formed as an adjusting screw which is threadedly received in said housing and movable longitudinally toward said plunger and away of said plunger so as to adjust its stroke.

10. A carpet stretcher device as defined in claim 1; and further comprising a handle connected with said housing.

11. A carpet stretcher device as defined in claim 10, wherein said handle is movable longitudinally relative to said housing and has a projection extending into the interior of said housing so as to engage said plunger and to move it when a user moves said handle relative to said housing.

* * * * *